US008186975B2

(12) United States Patent
Kochan, Jr.

(10) Patent No.: US 8,186,975 B2
(45) Date of Patent: May 29, 2012

(54) LOW PROFILE PUMP WITH FIRST AND SECOND ROTOR ARRANGEMENT

(75) Inventor: John R. Kochan, Jr., Naperville, IL (US)

(73) Assignee: Metropolitan Industries, Inc., Romeoville, IL (US)

( * ) Notice: Subject to any disclaimer, the term of this patent is extended or adjusted under 35 U.S.C. 154(b) by 699 days.

(21) Appl. No.: 11/465,858

(22) Filed: Aug. 21, 2006

(65) Prior Publication Data

US 2007/0048158 A1 Mar. 1, 2007

Related U.S. Application Data

(60) Provisional application No. 60/710,913, filed on Aug. 24, 2005.

(51) Int. Cl.
*F04D 29/18* (2006.01)

(52) U.S. Cl. ..... 417/423.7; 310/268

(58) Field of Classification Search ..... 417/423.5, 417/423.7; 310/268, 156.32, 156.33, 156.34, 310/156.35, 156.36, 156.37, 114, 112, 88
See application file for complete search history.

(56) References Cited

U.S. PATENT DOCUMENTS

| | | | | |
|---|---|---|---|---|
| 2,752,857 | A * | 7/1956 | White | 417/357 |
| 2,947,486 | A * | 8/1960 | Higer | 241/36 |
| 3,194,505 | A * | 7/1965 | Spackman | 241/194 |
| 4,108,386 | A * | 8/1978 | Conery et al. | 241/46.11 |
| 4,164,690 | A * | 8/1979 | Muller et al. | 318/400.41 |
| 4,640,666 | A * | 2/1987 | Sodergard | 415/121.1 |
| 5,016,825 | A * | 5/1991 | Carpenter | 241/46.06 |
| 5,744,896 | A | 4/1998 | Kessinger, Jr. et al. | |
| 5,892,307 | A * | 4/1999 | Pavlovich et al. | 310/68 B |
| 5,904,471 | A * | 5/1999 | Woollenweber et al. | 417/371 |
| 6,071,091 | A * | 6/2000 | Lemieux | 417/423.1 |
| 6,135,731 | A * | 10/2000 | Woollenweber et al. | 417/423.14 |
| 6,232,696 | B1 * | 5/2001 | Kim et al. | 310/156.37 |
| RE37,261 | E * | 7/2001 | Schmider et al. | 417/423.7 |
| 6,302,661 | B1 * | 10/2001 | Khanwilkar et al. | 417/423.7 |
| 6,422,838 | B1 | 7/2002 | Sloteman | |
| 6,648,252 | B2 * | 11/2003 | Strutz | 241/46.013 |
| 6,854,673 | B2 * | 2/2005 | Strutz et al. | 241/46.013 |

FOREIGN PATENT DOCUMENTS

JP 2000145682 A * 5/2000

OTHER PUBLICATIONS

Babyak, Richard, "Novel PM motor design provides higher power density and efficiency with less noise", Motors, Fans, Blowers & Pumps: Quiet Power, Apr. 1, 2005.*

"New Permanent Magnet Axial Gap Motor Developed", ZPEnergy, Apr. 15, 2003.*

Jacek F. Gieras, Rong-Jie Wang, Maarten J. Kamper, "Introduction", Axial Flux Permanent Magnet Brushless Machines, Kluwer (2004), pp. 1-5.*

(Continued)

*Primary Examiner* — Charles Freay
*Assistant Examiner* — Nathan Zollinger
(74) *Attorney, Agent, or Firm* — Husch Blackwell LLP

(57) ABSTRACT

Pumps with low profile disk-type motors can incorporate an impeller into one or both rotors. Alternately, a separate impeller can be attached to a rotor. The pumps can be contained in housings without seals as the rotors need not be mechanically attached.

11 Claims, 7 Drawing Sheets

OTHER PUBLICATIONS

Caricchi, et al., Low-cost compact permanent magnet machine for adjustable-speed pump application, IEEE Transactions on Industry Applcations, vol. 34, No. 1, Jan./Feb. 1998.*

RD442085.*

"Introduction to SEMA Motor Technology;" Kinetic Art & Technology (Jun. 2005) 4 pages.

* cited by examiner

LOW PROFILE PUMP WITH FIRST AND SECOND ROTOR ARRANGEMENT

CROSS-REFERENCE TO RELATED APPLICATION

This application claims the benefit of the filing date of U.S. Provisional Application Ser. No. 60/710,913 filed Aug. 24, 2005 and entitled "Low Profile Pump" and which is incorporated herein by reference.

FIELD OF THE INVENTION

The invention pertains to pumps. More particularly, the invention pertains to pumps which incorporate disk-type low profile motors.

BACKGROUND OF THE INVENTION

Known electrically driven pumps are widely used for different applications. Such pumps while effective for their intended purposes continue to suffer from various shortcomings.

Rising energy prices have a ripple effect which impacts both manufacturing costs and operational costs of such pumps. Plastic housings and other parts are often found in such pumps. Increasing prices for oil in turn raise the price of plastic products.

Operationally, because of relatively low historical costs of energy efficiency has not been as significant a parameter as it might be. This is not only an issue when the pumps are installed but also throughout their lifetime.

There thus continue to be unmet needs for low profile pump configurations which would incorporate very compact motors and smaller housings. Additionally, it would be desirable and beneficial if such pumps exhibited higher energy efficiencies than has heretofore been the case.

DETAILED DESCRIPTION

Figure 1:
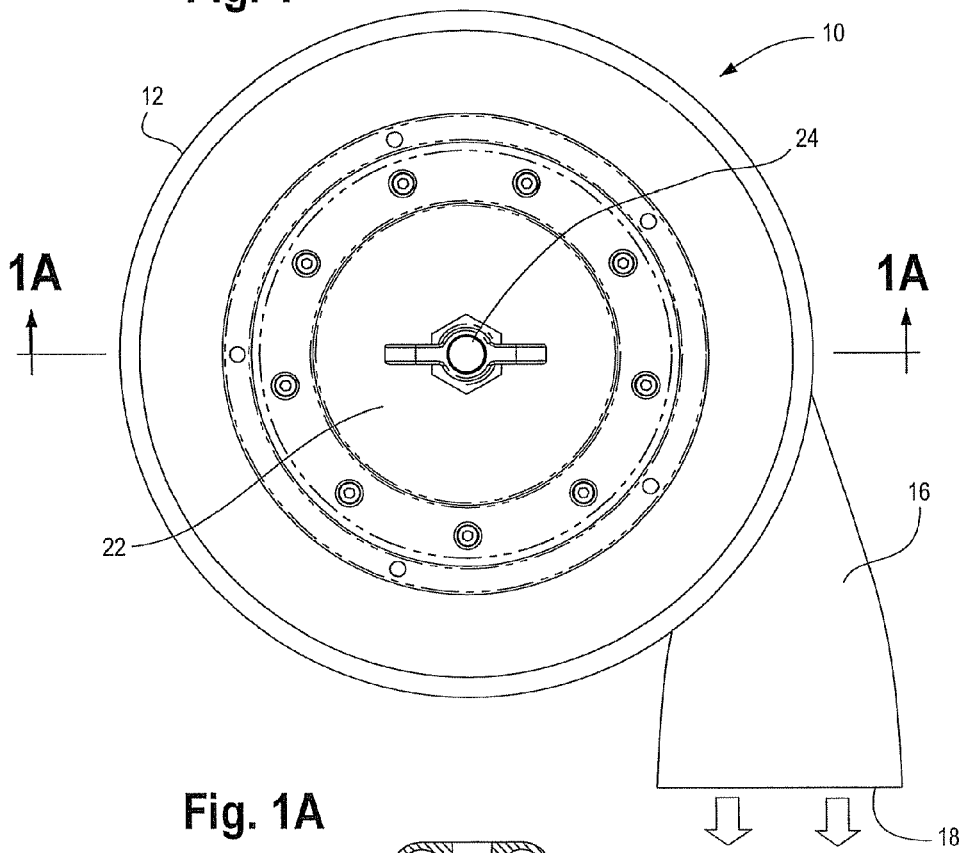
FIG. 1 is a top plan view of an end suction pump.

While embodiments of this invention can take many different forms, specific embodiments thereof are shown in the drawings and will be described herein in detail with the understanding that the present disclosure is to be considered as an exemplification of the principles of the invention, as well as the best mode of practicing same, and is not intended to limit the invention to the specific embodiment illustrated.

Pumps in accordance with the invention can be implemented with a wet stator, dry stator, have a shaft seal or not, use a rotor or both rotors as impellers or have a separate impeller. Brushless disk-type motors, (such as SEMA-type, segmented electro-magnetic array-type, motors disclosed in U.S. Pat. No. 5,744,896 entitled "Interlocking Segmented Coil Array" and incorporated by reference herein), can be used to provide compact high efficiency pumps.

A motor controller can be integrated into or separate from the motor. Such motors can be manufactured to be explosion-proof or work in the presence of hazardous chemicals by changing the configuration and materials. Such motors can also be adapted to drive any size or type of pump including submersible, turbine, grinder, progressive cavity, end suction, multi stage stacked or turbine type, split case, etc.

Another big advantage of such motors is inherent in their design. They are extremely energy efficient. The controller is a variable frequency drive that can be used as such in appropriate applications.

The controller also keeps the motor windings from burning up if the motor is jammed. It will only supply the current it is designed for so it will not allow overheating.

Such motors are also constant torque devices that will help to keep the pumps from clogging if the pumps happen to have debris in them when they are starting up.

So not only is a very compact motor available which will save weight and space in applying it to a pump end, it will save a tremendous amount of energy in use. Pumps which embody such motors can have designs that were not possible with conventional motors. For example, such motors could be used in "upside down" grinder pumps, commonly known as garbage disposals.

Figure 1A:
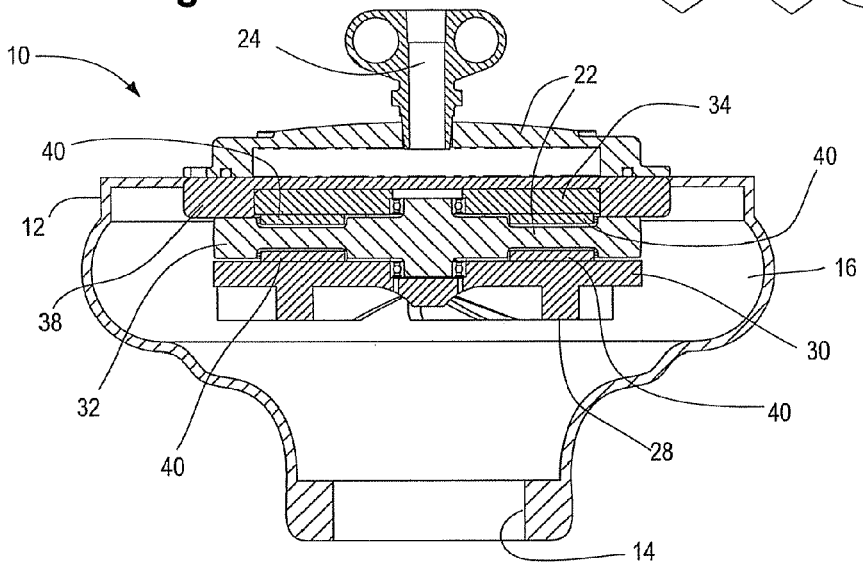
FIG. 1A is a sectional view taken along plane 1A-1A of FIG. 1.

FIGS. 1 and 1A illustrate a top plan view and a sectional view of a SEMA motor driven end suction pump 10. Pump 10 includes a housing 12 having a suction input port 14, a volute 16 and pumped fluid outflow port 18.

Pump 10 also incorporates a SEMA-type motor 22 which can be energized via input power port 24. As configured, pump 10 includes an impeller 28 which is coupled to or integrally formed as a part of one of the rotors 30. Motor 22 also includes an encapsulated stator 32 and a second rotor 34. The two rotors 30, 34 in the motor 22 need not be mechanically coupled together. Hence, pumps such as the pump 10 can be manufactured without seals which eliminate the possibility of water entry.

The motor 22 also carries a controller 38. The controller 38 which can be integrated into the stator 32 can be implemented as variable frequency drive. the motor 22 operates advantageously as a constant torque device which helps eliminate clogging when the pumps are initially started.

The motor 22 also incorporates a plurality of magnets, the members of which are indicated at 40, which keep the rotors, 30, 32 synchronized during normal operation.

Figure 2:
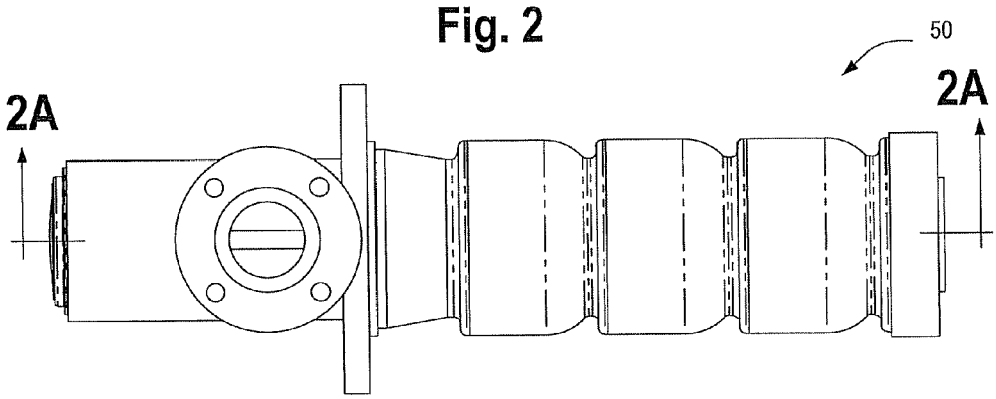
FIG. 2 is a side elevational view of a multi-stage/turbine pump.
Figure 2A:
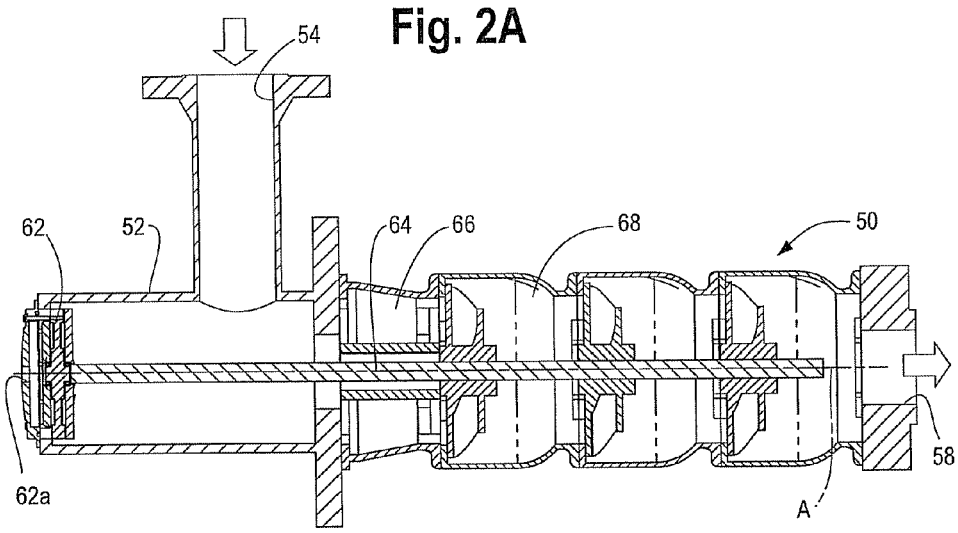
FIG. 2A is a sectional view taken along plane 2A-2A of FIG. 1.

FIGS. 2, 2A illustrate a side elevational view and a sectional view of a SEMA motor driven multi-stage/turbine pump 50. Pump 50 includes a housing 52 with a suction input 54 and a discharge port 58. A SEMA-type 62 is coupled via an axially oriented shaft 64, which rotates about axis A when driven by motor 62 to a bearing stage 66 and a multi-element pump stage 68. Those of skill in the art will understand that the number of required stages depends on pump capacity.

Electrical energy can be coupled via an input port 62*a* to the motor 62. The motor 62 incorporates a stator and controller of a type illustrated with respect to the motor 22 of pump 10.

Figure 3:
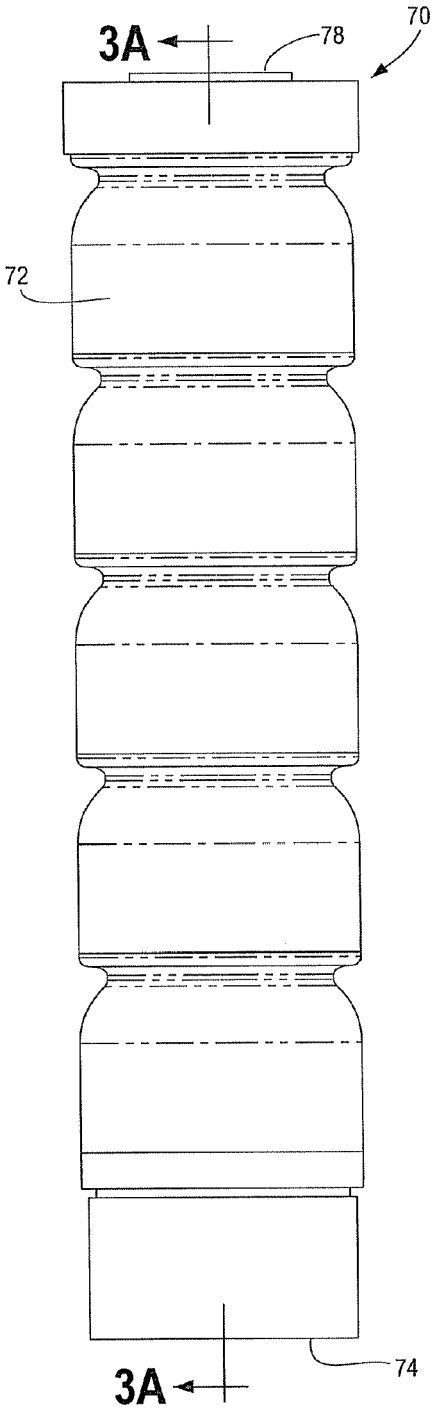
FIG. 3 is a side elevational view of a submersible multi-stage turbine pump.
Figure 3A:
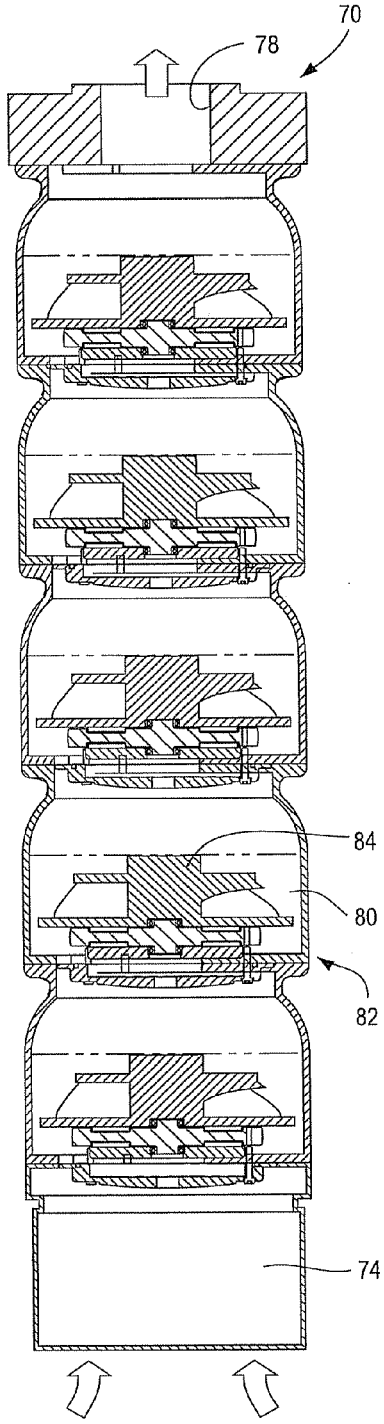
FIG. 3A is a sectional view taken along plane 3A-3A of FIG. 3.

FIGS. 3, 3A illustrate views of a submersible multi-stage turbine pump which incorporates an SEMA-type motor, 70. The pump 70 incorporates a multi-stage housing 72, a fluid inflow port 74 and an outflow port 78. Pump 70 incorporates a plurality of pump stages, such as representative pump stage 80.

Pump stage 80 incorporates an SEMA-type motor 82 and an associated impeller 84. The motor 82 can also include the stator and controller as in the case with the motor 22 of pump 10.

Those of skill in the art will understand that each of the stages of the pump 70 is substantially identical and previous discussion of the structure of stage 80 applies to each of the remaining stages as well. Electrical energy would be provided by an input port comparable to the input port 24 of the pump 10.

Figure 4:
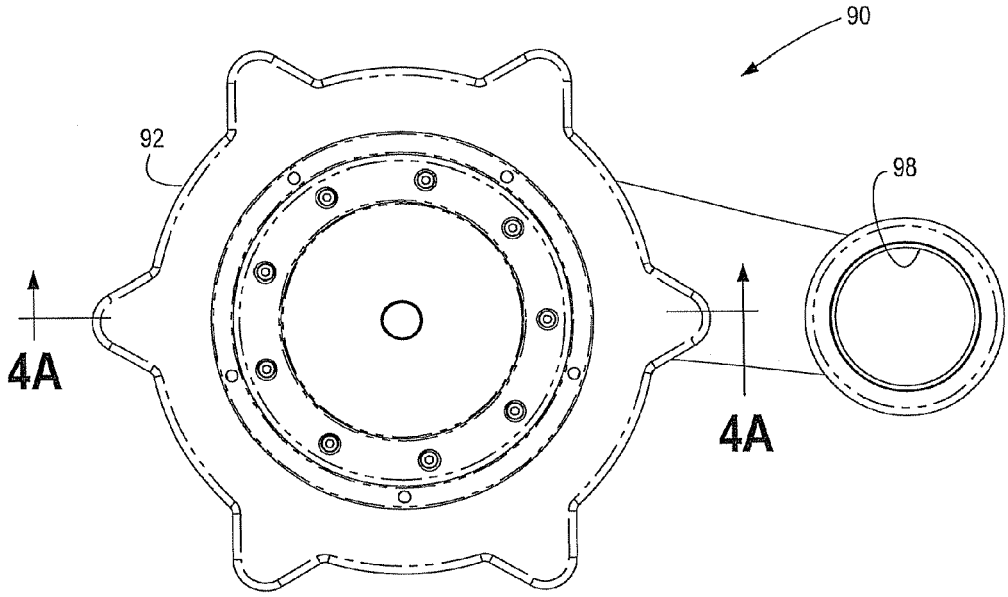
FIG. 4 is a top plan view of sewage grinder pump.
Figure 4A:
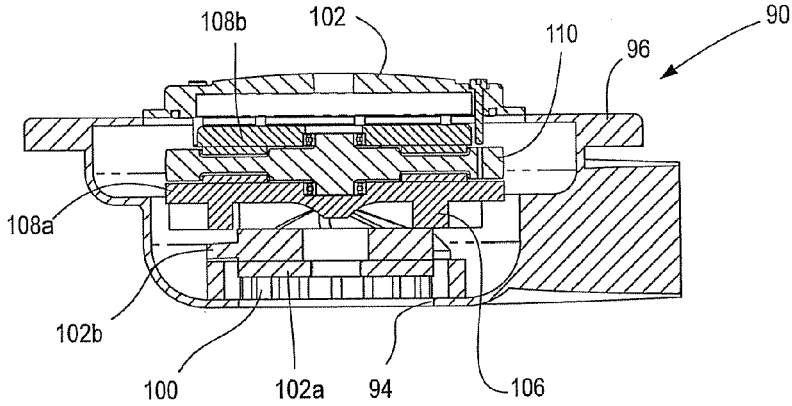
FIG. 4A is a sectional view taken along plane 4A-4A of FIG. 4.

FIGS. 4, 4A illustrate a top plan view and a sectional view of a sewage grinder pump 90 which incorporates an SEMA-type motor. Pump 90 incorporates a housing 92 with an inflow port 94, a pump volute 96 and outflow port 98. Pump 90 can be driven by an SEMA-type motor 102 comparable to the motor 22 of pump 10 of FIG. 1.

Pump 90 can also incorporate a rotary food waste or sewage grinding or cutter ring 100. The ring 10 incorporates a radial cutter 102*a* and an axial cutter 102*b*.

The motor 102 also incorporates an impeller 106 which is carried by a rotor 108*a*. A second rotor 108*b* is spaced from the rotor 108*a* by a stator 110.

Those with skill in the art will understand that the pump 90 can be installed with a variety of orientations depending on the direction of fluid inflow to the port 94.

Figure 5:
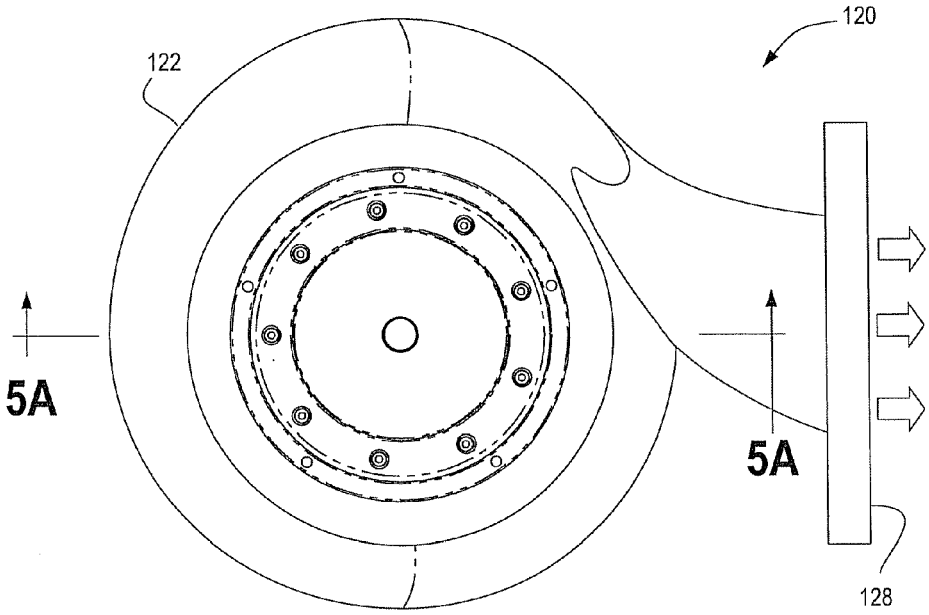
FIG. 5 is a side elevational view of a non-clogging sewage pump.
Figure 5A:
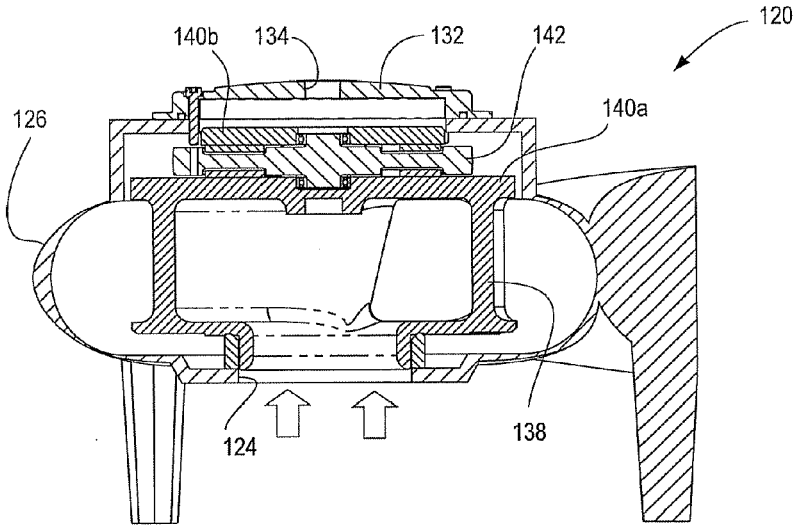
FIG. 5A is a sectional view taken along plane 5A-5A of FIG. 5.

FIGS. 5, 5A are a top plan view and a sectional view respectively of a non-clogging sewage pump 120 which incorporates an SEMA-type motor. The pump 120 incorporates a housing 122 with a fluid inflow port 124, a pump volute 126 and a fluid outflow port 128. Pump 120 also incorporates an SEMA-type motor 132 having a structure similar to the structure of motor 22 of pump 10.

Input power can be coupled to the motor 132 through energy input port 134. Pump 120 also incorporates an impeller 138 carried on a rotor 140*a* of the motor 132. A second rotor 140*b* is displaced from the rotor 140*a* by a stator 142.

Figure 6:
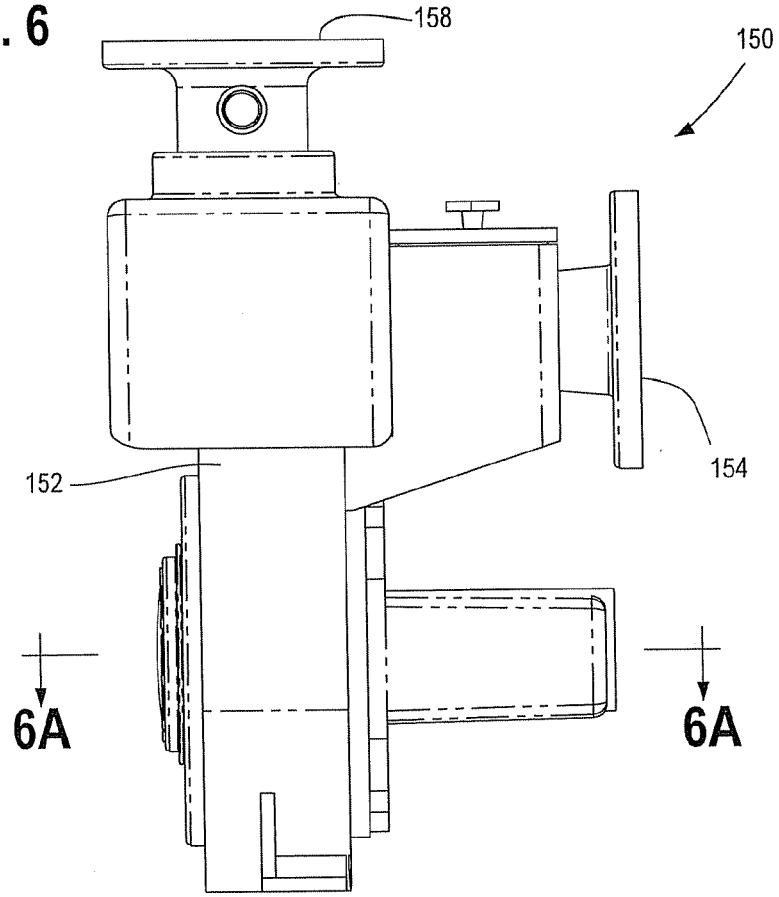
FIG. 6 is a side elevational view of a self-priming pump.
Figure 6A:
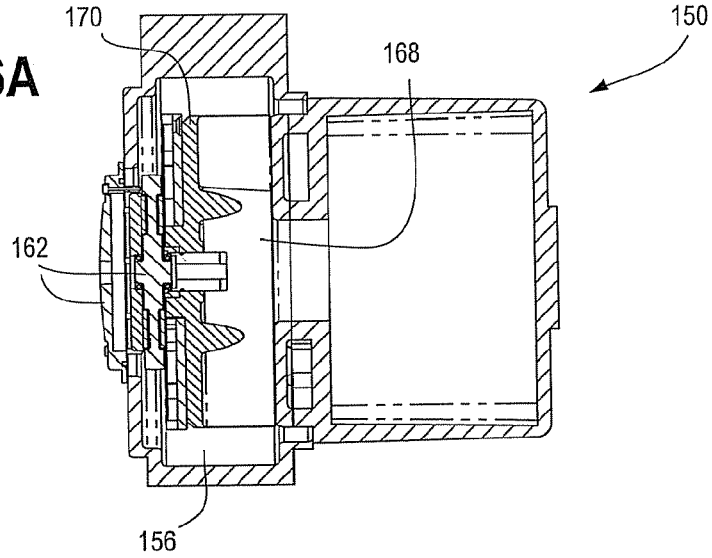
FIG. 6A is a sectional view taken along plane 6A-6A of FIG. 6.

FIGS. 6, 6A illustrate a side elevational view and a sectional view of a self-priming pump 150 actuated by an SEMA-type motor. The pump 150 includes a housing 152 with a suction, input port 154, a pump volute 156 and a discharge or outflow port 158. The pump 150 incorporates an SEMA-type motor 162 which rotates an associated impeller 168. The impeller 168 is carried on a rotor 170 of the motor 162.

Figure 7:
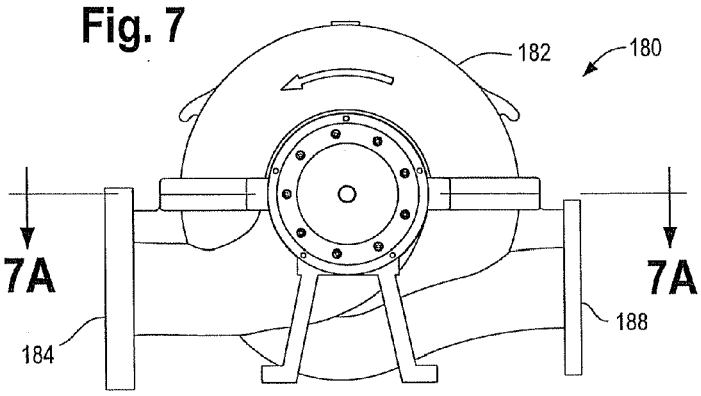
FIG. 7 is a side elevational view of a split case pump.
Figure 7A:
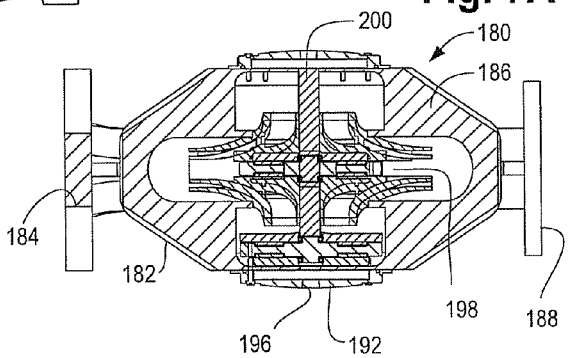
FIG. 7A is a sectional view taken along plane 7A-7A of FIG. 7.

FIGS. 7, 7A are side elevational and sectional views of a split case pump 180 with a housing 182. Pump 180 incorporates a suction, input port 184, a pump volute 186 and a discharge or output port 188. Pump 180 is activated by an externally located SEMA-type motor 192 which is energized through an input port 196. An impeller 198 can be coupled to one of the rotors of the motor 192 by a shaft 200.

Figure 8:
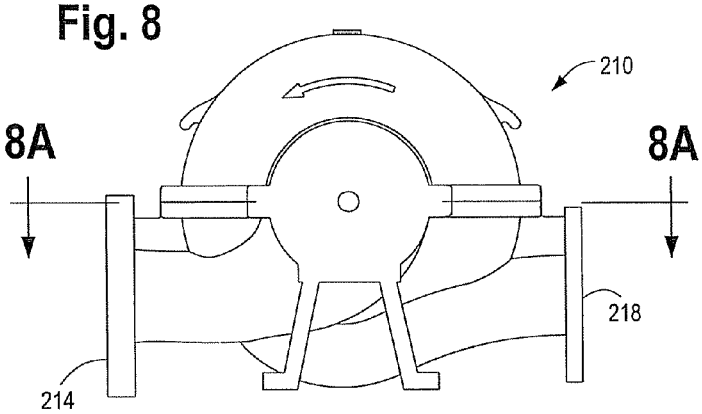
FIG. 8 is a side elevational view of a split case pump with an internal motor.
Figure 8A:
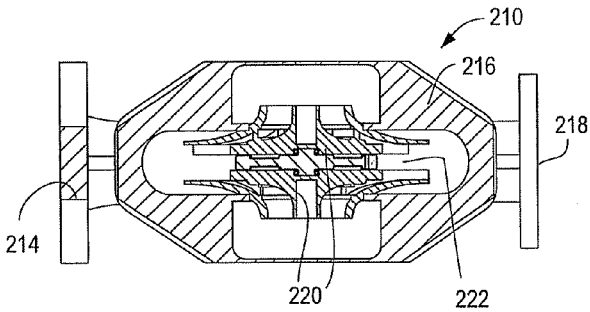
FIG. 8A is a sectional view taken along plane 8A-8A of FIG. 8.

FIGS. 8, 8A are side elevational and sectional views of another split case pump 210. Pump 210 incorporates a suction input port 214, a pump volute 216 and a discharge or output port 218. Pump 210 is activated by an internally located SEMA motor 220. The motor 220 is formed as an integral part of the impeller rotating assembly 222. In the pump 210 no external shafting is required.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

The invention claimed is:

1. A pump comprising:

a segmented electro-magnetic array motor, the motor comprising:

a stator;

a first and a second rotor on opposing sides of the stator; and a pump impeller carried by the first rotor, said impeller integrally formed with said first rotor and extending seamlessly from said first rotor in an axial direction, and the pump further comprising a housing with first and second ends, with the stator carried by and extending into the housing from a point of attachment of the stator with the housing towards the center of the housing and the first rotor and impeller carried by the stator within the housing to eliminate the possibility of water entry, and wherein the housing carries a centrally located electrical input port at one end, wherein the housing carries a fluid inlet at the other end and a pumped fluid outlet located between the electrical input port and the pumped fluid inlet and where the first and second rotors are not mechanically coupled together.

2. A pump as in claim 1 wherein the first rotor and the impeller rotate in response to electrical energy received at the input port.

3. A pump as in claim 1 wherein the first rotor is substantially disk-shaped and the first rotor is positioned between the stator and the impeller, along a common center line.

4. A pump as in claim 2 configured as one of an end suction pump or a non-clogging sewage pump.

5. A food products grinder pump comprising:

a housing which defines a region which receives food products to be ground up via an inflow port to the region;

a rotatably mounted grinder; and a brushless disk-type motor having a stator and a first and a second rotor on opposing sides of the stator with the first rotor coupled to the grinder wherein the motor extends into the housing from a point of attachment of the stator with the housing with the stator of the motor carried by the housing and the first rotor carried by the stator within the housing to eliminate water entry wherein a cutter ring is located adjacent to and faces toward the inflow port and, an impeller integrally formed with the first rotor and extending seamlessly from the first rotor in an axial direction and wherein the first and second rotors are not mechanically coupled together.

6. A pump as in claim 5 wherein the housing defines a ground products outflow port and the grinder, when activated, directs ground products to the outflow port.

7. A pump as in claim 5 wherein when the housing has an operational orientation, gravitational forces promote inflowing fluid and products to contact the grinder.

8. A pump as in claim 7 wherein the grinder, when rotating, promotes a fluid and ground product outflow from an outflow port.

9. A pump as in claim 5 where the motor comprises a segmented electromagnetic array motor carried by the housing.

10. A pump comprising:

a segmented electro-magnetic array motor, the motor comprising:

a stator;

a first and a second rotor on opposing sides of the stator;

a first pump impeller carried by the first rotor, said first impeller integrally formed with said first rotor and extending seamlessly from said first rotor in an axial direction;

a second pump impeller carried by the second rotor, said second impeller integrally formed with said second rotor and extending seamlessly from said second rotor in an axial direction; and the pump further comprising a housing with first and second ends and an inlet port on the first end and an outlet port on the second end, with the stator carried within the housing and the first rotor and impeller carried by the stator within the housing and where the first and second rotors are not mechanically coupled together.

11. The pump as in claim 10 wherein the housing further comprises a split case enclosing the stator, the first and second rotors and integral impellers.

* * * * *